US010274172B1

(12) United States Patent
Chiu et al.

(10) Patent No.: US 10,274,172 B1
(45) Date of Patent: Apr. 30, 2019

(54) LAMP

(71) Applicant: Beautiful Light Technology Corp., Chiayi (TW)

(72) Inventors: Shih-Ting Chiu, Chiayi (TW); Chien-Wen Chiu, Chiayi (TW)

(73) Assignee: BEAUTIFUL LIGHT TECHNOLOGY CORP., Chiayi (TW)

( * ) Notice: Subject to any disclaimer, the term of this patent is extended or adjusted under 35 U.S.C. 154(b) by 0 days.

(21) Appl. No.: 15/901,857

(22) Filed: Feb. 21, 2018

(30) Foreign Application Priority Data

Dec. 14, 2017 (TW) ..... 106218575 U

(51) Int. Cl.

| | |
|---|---|
| ***F21V 17/02*** | (2006.01) |
| ***F21V 29/70*** | (2015.01) |
| ***F21K 9/232*** | (2016.01) |
| ***F21K 9/235*** | (2016.01) |
| ***F21K 9/237*** | (2016.01) |
| ***F21K 9/238*** | (2016.01) |
| ***F21V 23/00*** | (2015.01) |
| ***F21V 31/00*** | (2006.01) |
| ***F21V 17/16*** | (2006.01) |

(52) U.S. Cl.
CPC ..... *F21V 17/02* (2013.01); *F21K 9/232* (2016.08); *F21K 9/235* (2016.08); *F21K 9/237* (2016.08); *F21K 9/238* (2016.08); *F21V 17/16* (2013.01); *F21V 23/001* (2013.01); *F21V 29/70* (2015.01); *F21V 31/005* (2013.01)

(58) Field of Classification Search
None
See application file for complete search history.

(56) References Cited

U.S. PATENT DOCUMENTS

| | | | | |
|---|---|---|---|---|
| 8,072,123 | B1 | 12/2011 | Han | |
| 2010/0033969 | A1* | 2/2010 | Hochstein | F21K 9/00 362/249.03 |
| 2014/0049972 | A1 | 2/2014 | McGuire et al. | |
| 2014/0376230 | A1* | 12/2014 | Chiu | F21V 29/85 362/294 |
| 2016/0356466 | A1* | 12/2016 | Recor | F21V 21/26 |
| 2017/0299151 | A1 | 10/2017 | Luo | |

FOREIGN PATENT DOCUMENTS

| | | | |
|---|---|---|---|
| KR | 20100076289 | A | 7/2010 |
| KR | 20130075028 | A | 7/2013 |

* cited by examiner

*Primary Examiner* — Ashok Patel
(74) *Attorney, Agent, or Firm* — CKC & Partners Co., LLC

(57) ABSTRACT

A lamp includes a bottom base, a connecting rod, at least one first light source assembly, a connecting base, a lamp housing and a lamp cap. The connecting rod has a first end and a second end, and the first end is disposed on the bottom base. One end of the first light source assembly is disposed on the bottom base, and the first light source assembly is swingable relative to the connecting rod. The connecting base is disposed on the second end of the connecting rod. A circuit board is disposed in an accommodating space of the lamp housing and is electrically connected to the first light source assembly, and the connecting base is disposed on the lamp housing and covers accommodating space. The lamp cap is disposed on one end of the lamp housing, and the lamp cap is electrically connected to the circuit board.

15 Claims, 7 Drawing Sheets

LAMP

RELATED APPLICATIONS

This application claims priority to Taiwan Application Serial Number 106218575, filed on Dec. 14, 2017, which is incorporated herein by reference.

BACKGROUND

Field of Invention

The present invention relates to a lamp. More particularly, the present invention relates to a lamp which can generate different light shapes.

Description of Related Art

Light emitting diodes (LEDs) have advantages of small size, low driving voltage, long service life and environmental protection. Therefore, light emitting diode bulbs (LED bulbs) have gradually replaced convention mercury lamps or gas-discharge lamps and have been used widely. However, some LED bulbs only have limited light-emitting angle. Large-scale lamps which are used in large spaces such as parks, warehouses, or plazas often use reflectors to reflect the light emitted from the LED bulbs, so as to create a particular light shape.

However, because different light shapes are required by different spaces, the existing large-scale lamps cannot meet all requirements of different spaces.

SUMMARY

An object of the invention is to provide a lamp, and the light-emitting angles and light shapes of the lamp are adjustable.

According to the aforementioned object, a lamp is provided. The lamp includes a bottom base, a connecting rod, at least one first light source assembly, a connecting base, a lamp housing and a lamp cap. The bottom base has a first side and a second side opposite to each other. The connecting rod has a first end and a second end opposite to the first end, in which the first end is disposed on the bottom base. One end of the first light source assembly is disposed on the first side of the bottom base, and the first light source assembly is swingable relative to the connecting rod about the end as a swing center of the first light source assembly. The connecting base is disposed on the second end of the connecting rod. The lamp housing has an accommodating space, in which a circuit board is disposed in the accommodating space, and the circuit board is electrically connected to the first light source assembly, and the connecting base is disposed on the lamp housing and covers accommodating space. The lamp cap is disposed on one end of the lamp housing, in which the lamp cap is electrically connected to the circuit board.

According to an embodiment of the present invention, the lamp further includes a plate structure disposed on the bottom base. Each of the at least one first light source assembly includes a heat sink, a first light source substrate and a first lamp cover. The heat sink has an extending portion, in which the extending portion extends from one end of the heat sink, and a pivot portion is disposed on one end of the extending portion. The first light source substrate is disposed on one side of the heat sink. The first lamp cover covers the first light source substrate. The bottom base has at least one recessed portion, in which the extending portion is correspondingly disposed in the recessed portion, and the pivot portion is located between the plate structure and the bottom base.

According to an embodiment of the present invention, a teeth structure is disposed on the pivot portion. A flat spring is disposed on a side surface of the plate structure facing the bottom base, in which the flat spring is elastically engaged with the teeth structure.

According to an embodiment of the present invention, the heat sink has a through hole, and the first light source substrate is electrically connected to the circuit board via an electric wire, in which the electric wire is put through the through hole and extends in the connecting rod to be connected to the first light source substrate and the circuit board.

According to an embodiment of the present invention, the lamp further includes a waterproof tube disposed in the recessed portion, in which the waterproof tube has a first end and a second end opposite to each other, in which the first end is communicated with the through hole of the heat sink, and the second end is communicated with an opening of the recessed portion, and the electric wire is put in the waterproof tube and extends to the bottom base.

According to an embodiment of the present invention, the lamp further includes a second light source assembly disposed on the second side of the bottom base, and the second light source assembly is electrically connected to the circuit board.

According to an embodiment of the present invention, the second light source assembly includes a second light source substrate and a second lamp cover. The second light source substrate is electrically connected to the circuit board via an electric wire which passes through the connecting rod. The second lamp cover covering the second light source substrate.

According to an embodiment of the present invention, the lamp further includes a second light source assembly disposed on the second side of the bottom base, and the second light source assembly is electrically connected to the circuit board and the first light source assembly.

According to an embodiment of the present invention, the second light source assembly includes a second light source substrate and a second lamp cover, in which the second light source substrate is electrically connected to the circuit board via the electric wire, and the electric wire is connected to the circuit board by passing through the connecting rod. The heat sink has a through hole, in which the first light source substrate is electrically connected to the second light source substrate via the electric wire which passes through the through hole.

According to an embodiment of the present invention, the lamp further includes a waterproof tube disposed in the recessed portion, in which the waterproof tube has a first end and a second end opposite to each other, in which the first end is communicated with the through hole of the heat sink, and the second end is communicated with an opening of the recessed portion, and the electric wire is put in the waterproof tube and extends to the bottom base.

According to an embodiment of the present invention, the connecting rod includes an outer tube and an inner tube engaged with each other.

According to an embodiment of the present invention, a waterproof sealer is disposed between the lamp housing and the connecting base.

According to an embodiment of the present invention, the first lamp cover is fixed on the heat sink, and a waterproof sealer is disposed between the first lamp cover and the heat sink.

According to an embodiment of the present invention, the second lamp cover is fixed on the bottom base, and a waterproof sealer is disposed between the second lamp cover and the bottom base.

According to the aforementioned embodiments of the present invention, the light shape emitted from the lamp can be adjusted by changing the positioning angle of the first light source assembly. Moreover, the first light source assembly can be positioned at different required angles by engaging the teeth structure with the flat spring. In addition, the distance between the lamp cap and the first light source assembly can be changed by adjusting the length of the connecting rod, so that the illumination position of the lamp can be changed to meet different requirements.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
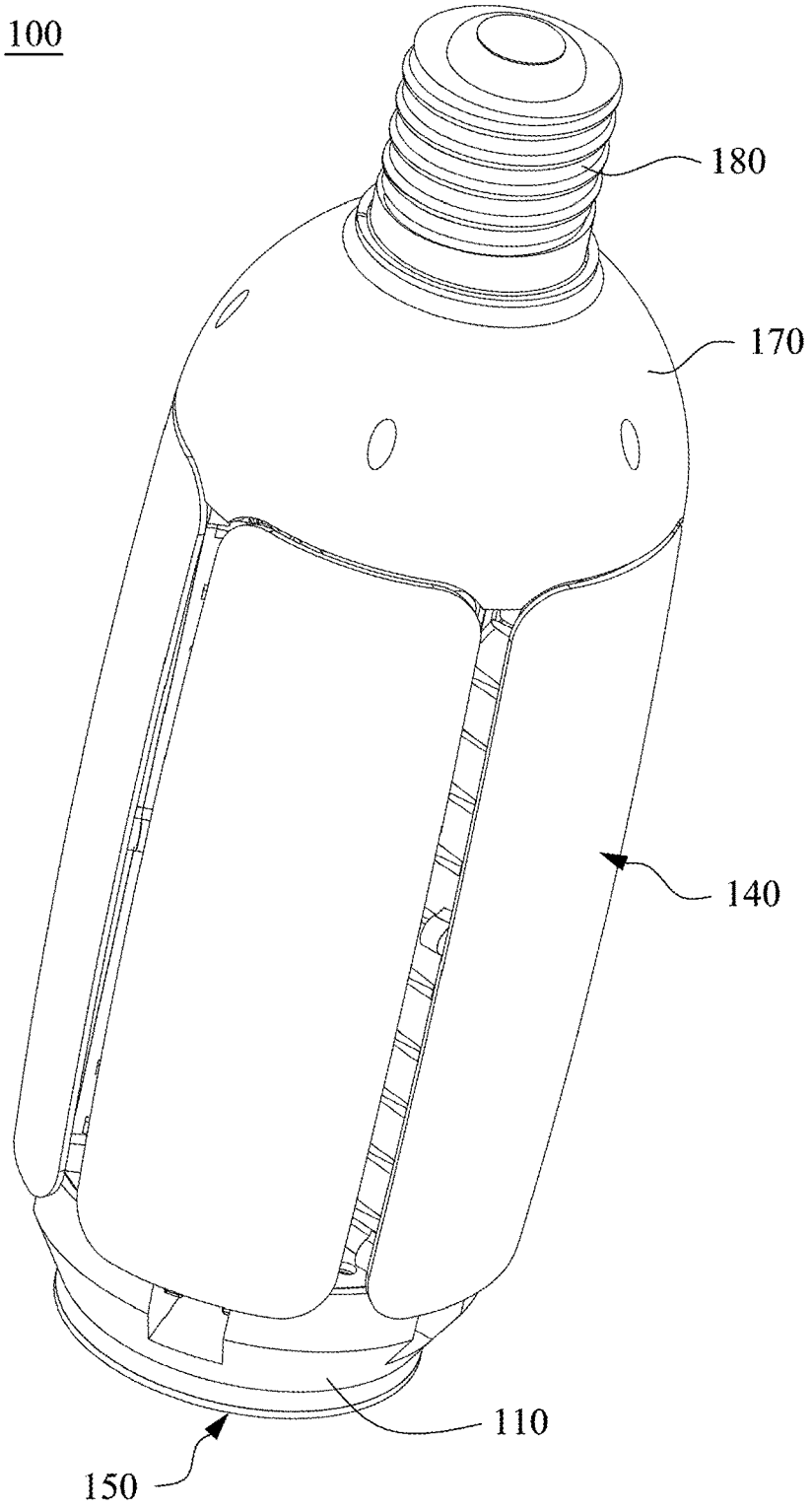
FIG. 1 is a schematic structural diagram showing a lamp in accordance with an embodiment of the present invention.
Figure 2:
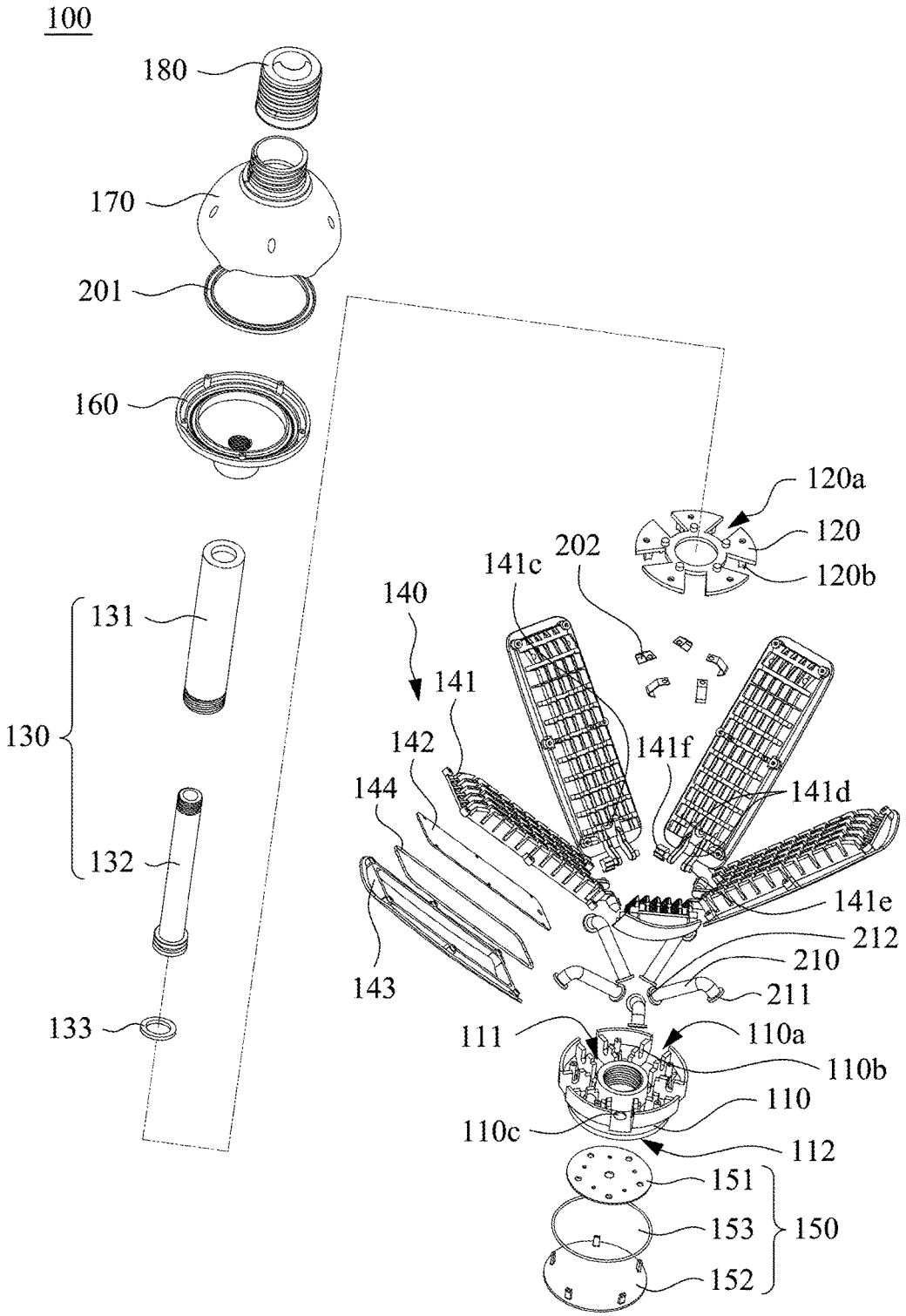
FIG. 2 is a schematic exploded view of the lamp in accordance with an embodiment of the present invention.
Figure 5:
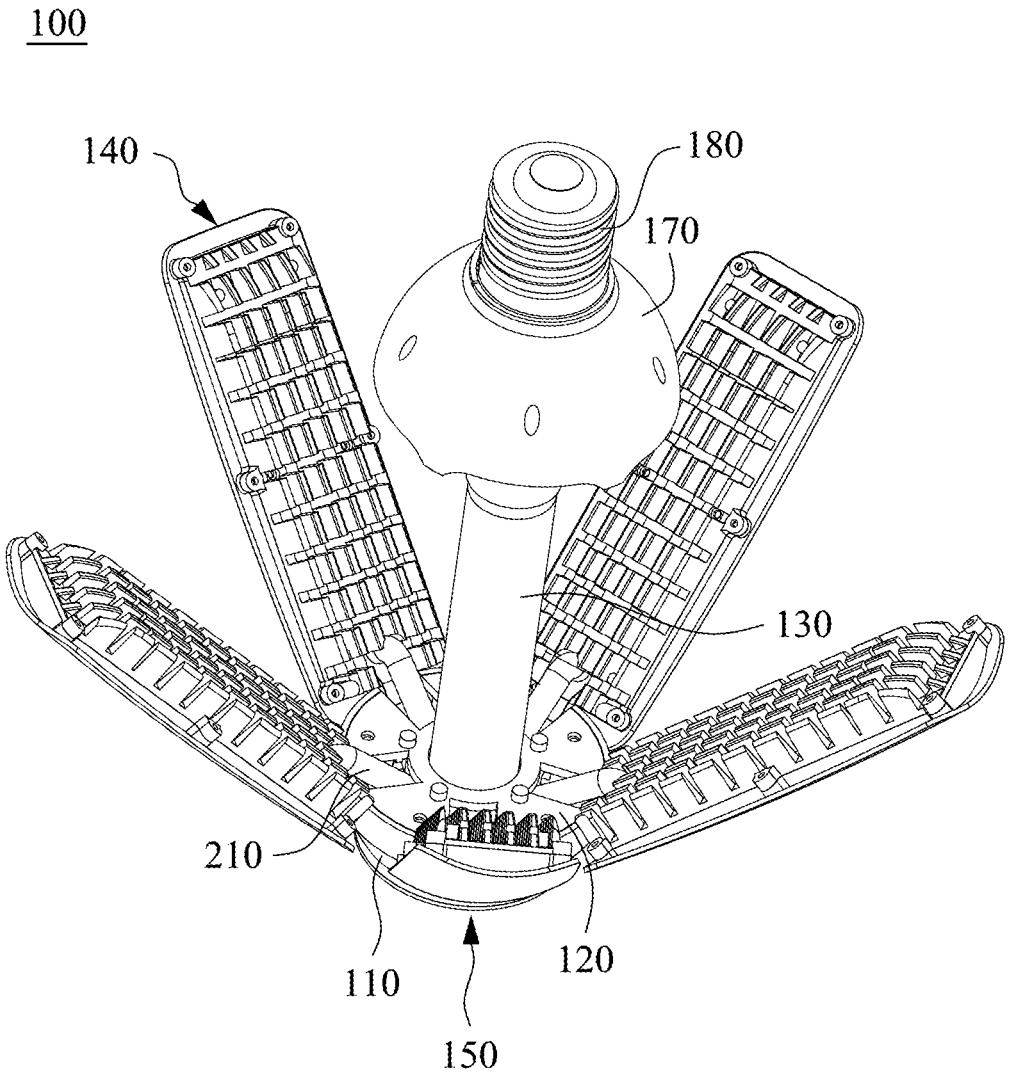
FIG. 5 and FIG. 6 are schematic structural diagrams showing first light source assembly positioned at different angles.
Figure 6:
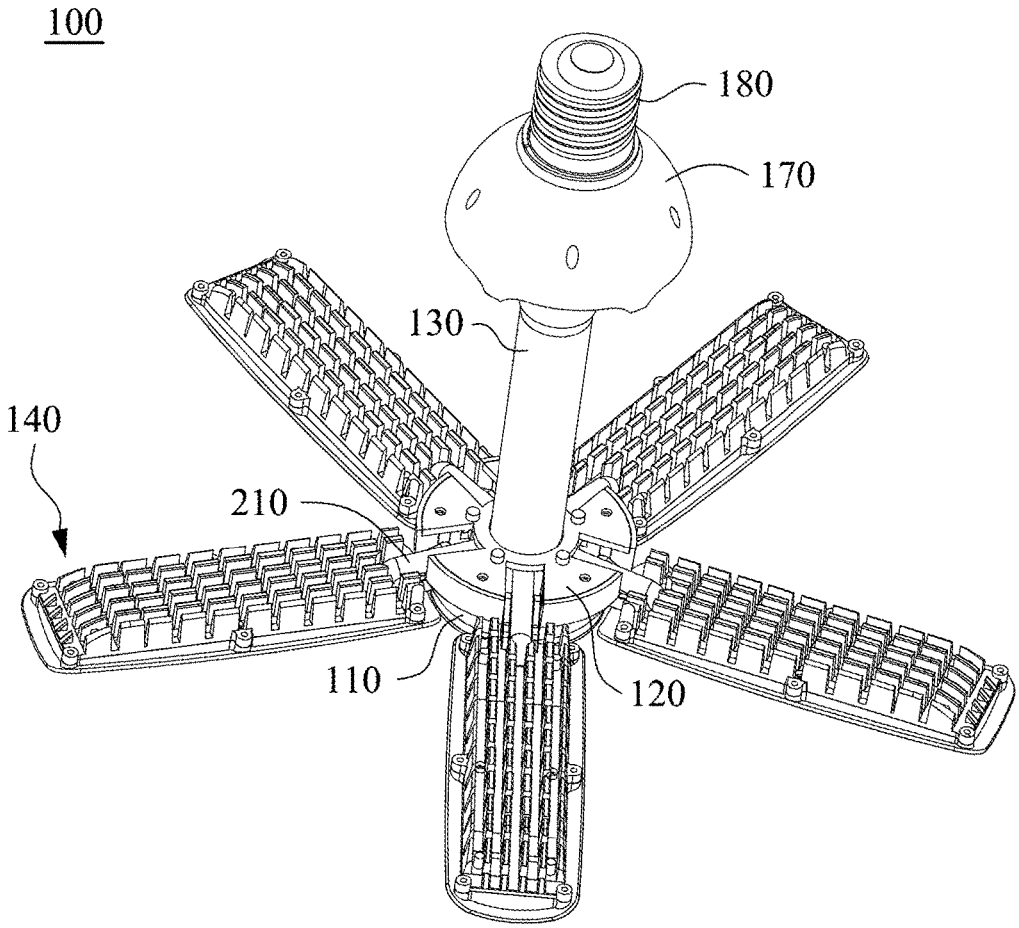

Referring to FIG. 1 and FIG. 2, FIG. 1 and FIG. 2 are a schematic structural diagram and a schematic exploded view showing a lamp 100 in accordance with an embodiment of the present invention. The lamp 100 of the present embodiment mainly includes a bottom base 110, a plate structure 120, a connecting rod 130, at least one first light source assembly 140, a second light source assembly 150, a connecting base 160, a lamp housing 170 and a lamp cap 180. In the present embodiment, the first light source assembly 140 is disposed on the bottom base 110 and is swingable relative to a connecting end between the first light source assembly 140 and the bottom base 110 as its swing center (as shown in FIG. 5 and FIG. 6), so as to adjust the light shape emitted from the lamp 100. It is noted that, there are five first light source assemblies 140 which are merely used as an example for explanation, and embodiments of the present invention are not limited thereto. In other embodiment, the number of the first light source assembly 140 can be designed according to different requirements.

Figure 3:
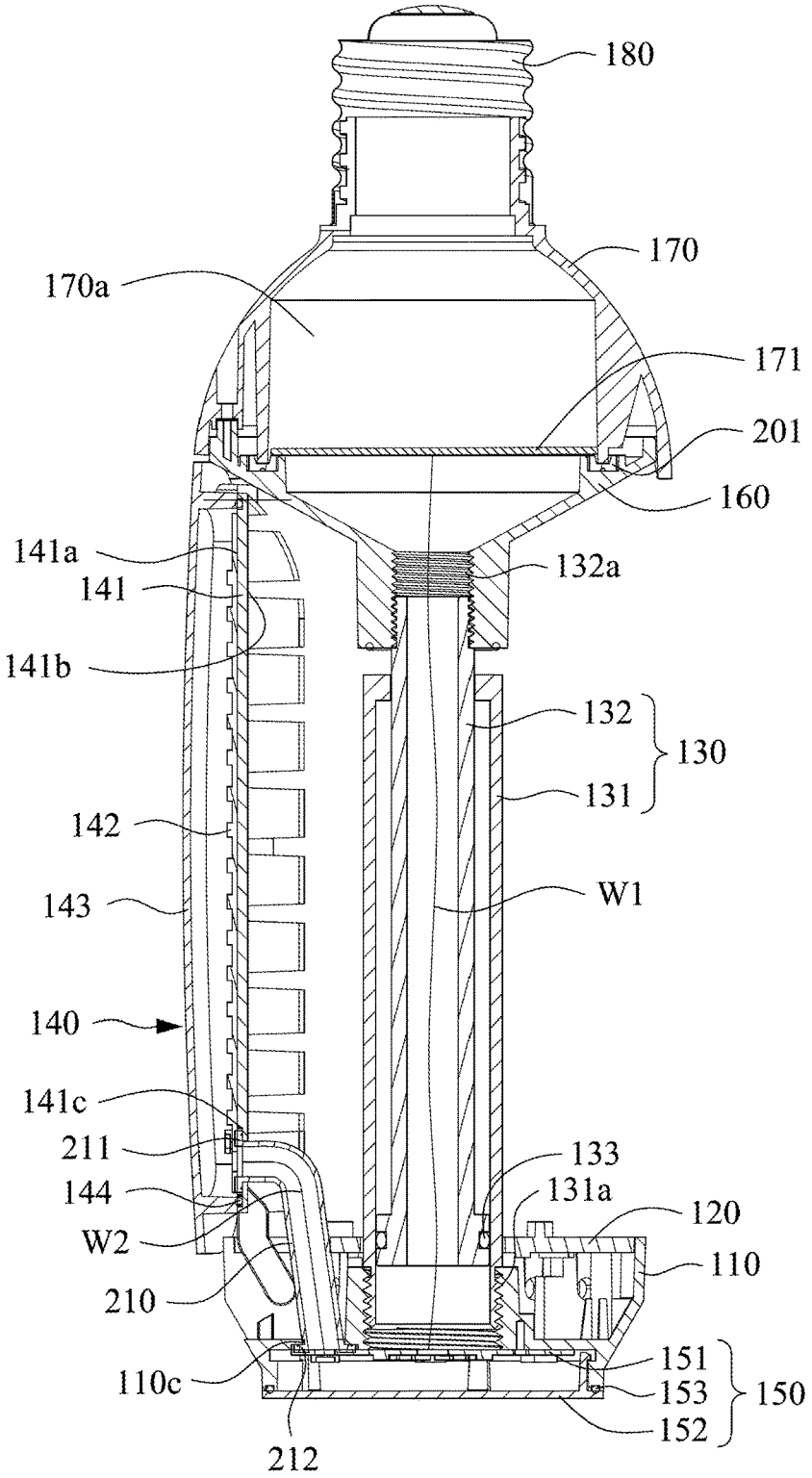
FIG. 3 is a partial cross-sectional view showing the lamp in accordance with an embodiment of the present invention.

Simultaneously referring to FIG. 2 and FIG. 3, FIG. 3 is a partial cross-sectional view showing the lamp in accordance with an embodiment of the present invention. It is noted that, in order to clearly illustrate the structures of the lamp 100, not all of the members of the lamp 100 are illustrated in FIG. 3. The bottom base 110 has a first side 111 and a second side 112 opposite to each other. One end 131*a* of the connecting rod 130 is disposed on the first side 111 of the bottom base 110, and the first light source assembly 140 is disposed on the first side 111 of the bottom base 110 and surrounds the connecting rod 130. The plate structure 120 is disposed on the first side 111 of the bottom base 110, and the connecting rod 130 is put through the plate structure 120. The second light source assembly 150 is disposed on the second side 112 of the bottom base 110. The second light source assembly 150 includes a second light source substrate 151 and a second lamp cover 152. The second light source substrate 151 and the second lamp cover 152 are disposed on the bottom base 110, and the second lamp cover 152 covers the second light source substrate 151. A waterproof sealer 153 is disposed between the second lamp cover 152 and the bottom base 110, so as to prevent outer moisture from entering inside the second light source assembly 150.

Referring to FIG. 2 and FIG. 3 again, the connecting base 160 is disposed on the other end 132*a* of the connecting rod 130. The lamp housing 170 has an accommodating space 170*a*, and a circuit board 171 is disposed in the accommodating space 170*a*. The connecting base 160 is fixed on the lamp housing 170 and covers the accommodating space 170*a*. The lamp cap 180 is disposed on one end of the lamp housing 170 and is electrically connected to the circuit board 171. The lamp cap 180 is used to be screwed into a light bulb socket to conduct electric power to the circuit board 171. The circuit board 171 is electrically connected to the first light source assembly 140 and the second light source assembly 150, and is used to provide electric power and control signal to the first light source assembly 140 and the second light source assembly 150. In some examples, a waterproof sealer 201 can be disposed between the connecting base 160 and the lamp housing 170, so as to prevent outer moisture from entering inside the lamp housing 170.

Referring to FIG. 2 and FIG. 3 again, the first light source assembly 140 includes a heat sink 141, a first light source substrate 142 and a first lamp cover 143. The heat sink 141 has a first side surface 141*a* and a second side surface 142*b* opposite to the first side surface 141*a*. The first light source substrate 142 is disposed on the first side surface 141*a*, and plural heat dissipation fins are disposed on the second side surface 142*b*. The first lamp cover 143 is fixed on the heat sink 141 and covers the first light source substrate 142. In one embodiment, the heat sink 141 has a through hole 141*c* extending from the first side surface 141*a* to the second side surface 142*b*, and an electric wire (i.e. electric wire W2) can be put in the through hole 141*c* to electrically connect the first light source substrate 142 to other members disposed on the lamp 100, such as the circuit board 171 or the second light source substrate 151. A waterproof sealer 144 is disposed between the first lamp cover 143 and the heat sink 141, so as to prevent outer moisture from entering inside the first light source assembly 140.

Figure 4:
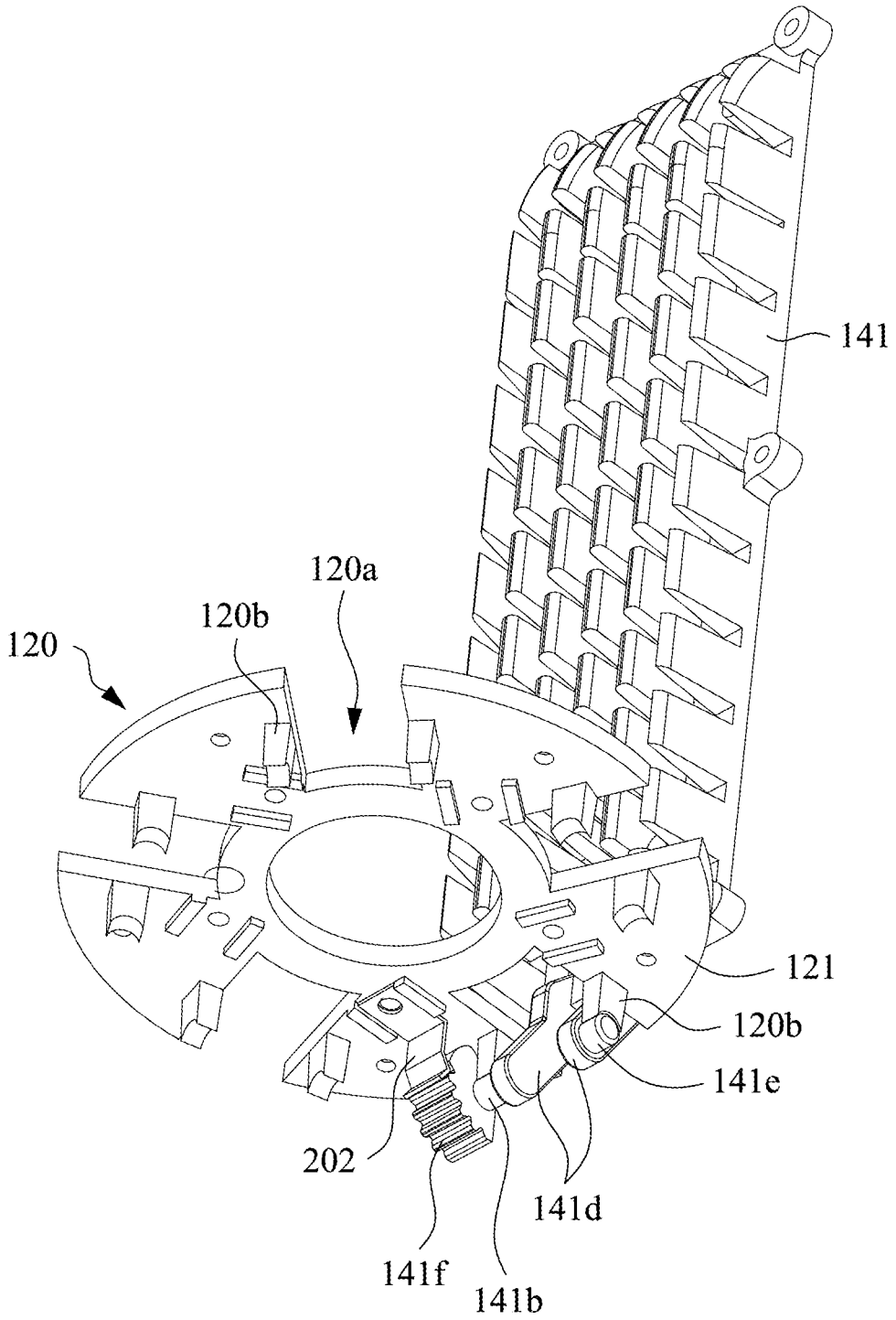
FIG. 4 is a schematic structural diagram showing the structural relationship of a heat sink and a plate structure.

Simultaneously referring to FIG. 2 and FIG. 4, FIG. 4 is a schematic structural diagram showing the structural relationship of a heat sink 141 and a plate structure 120. As shown in FIG. 2, the bottom base 110 has plural recessed portions 110*a*, and two opposite sidewalls of each of the recessed portions 110*a* respectively disposed with a concave arc structure 110*b*. In the present embodiment, the number of the recessed portions 110*a* of the bottom base 110 is corresponding to the number of the first light source assembly 140. The heat sink 141 has an extending portion 141*d* extending from one end of the heat sink 141. One end of the extending portion 141*d* has a pivot portion 141*e*, and the extending portion 141*d* and the pivot portion 141*e* are formed in an L-shaped structure. The extending portion 141*d* is disposed in the recessed portion 110*a*, and the pivot portion 141*e* is located in the concave arc structure 110*b*. As shown in FIG. 4, the plate structure 120 has plural recessed portions 120*a*, and the number of the recessed portions 120*a* is corresponding to the number of the recessed portions 110*a* of the bottom base 110. Moreover, two sides of each of the recessed portions 120*a* of the plate structure 120 are disposed with the concave arc structures 120*b*. Therefore, when the plate structure 120 is fixed on the bottom base 110, the extending portion 141*d* of the heat sink 141 is located in the recessed portion 120*a*, and the pivot portion 141*e* is located between the concave arc structure 120*b* and the concave arc structure 110*b*, so that the heat sink 141 can be rotated relative to the bottom base 110 via the pivot portion 141*e*.

As shown in FIG. 2 and FIG. 4, the pivot portion 141*e* of the heat sink 141 has a teeth structure 141*f*. A flat spring 202 is disposed on one surface of the plate structure 120 facing the bottom base 110, and the flat spring 202 is elastically engaged with one of teeth portions of the teeth structure 141*f*. Therefore, by engaging the flat spring 202 with the teeth structure 141*f*, the first light source assembly 140 can be positioned at a required angle. Take FIG. 5 and FIG. 6 as an example, FIG. 5 and FIG. 6 are schematic structural diagrams showing first light source assembly 140 respectively positioned at 45 degrees and 90 degrees. Therefore, the light shape emitted from the lamp 100 can be adjusted by changing the positioning angle of the first light source assembly 140.

Referring to FIG. 2 and FIG. 3 again, in some examples, the connecting rod 130 is a hollow tube. When one end 131*a* of the connecting rod 130 is put through the plate structure 120 and is disposed on the bottom base 110, the second light source substrate 151 of the second light source assembly 150 can be electrically connected to the circuit board 171 by the electric wire W1 which is disposed in the connecting rod 130. Meanwhile, the first light source substrate 142 of the first light source assembly 140 can be electrically connected to the second light source substrate 151 by the electric wire W1 which passes through the through hole 141*c* of the heat sink 141. As shown in FIG. 2 and FIG. 3, the lamp 100 further includes plural waterproof tubes 210. Each of the waterproof tube 210 has a first end 211 and a second end 212 opposite to each other. The first end 211 of the waterproof tube 210 is disposed on the through hole 141*c* of the heat sink 141, and the second end 212 is disposed in an opening 110*c* located on the recessed portion 110*a*. Therefore, the electric wire W2 which is connected to the first light source substrate 142 can pass through the through hole 141*c* of the heat sink 141 and the waterproof tube 210 to extend to the bottom base 110, so as to be connected to the second light source substrate 151. The waterproof tube 210 is mainly used to protect the electric wire W2 and prevent outer moisture from entering inside the lamp 100.

Figure 7:
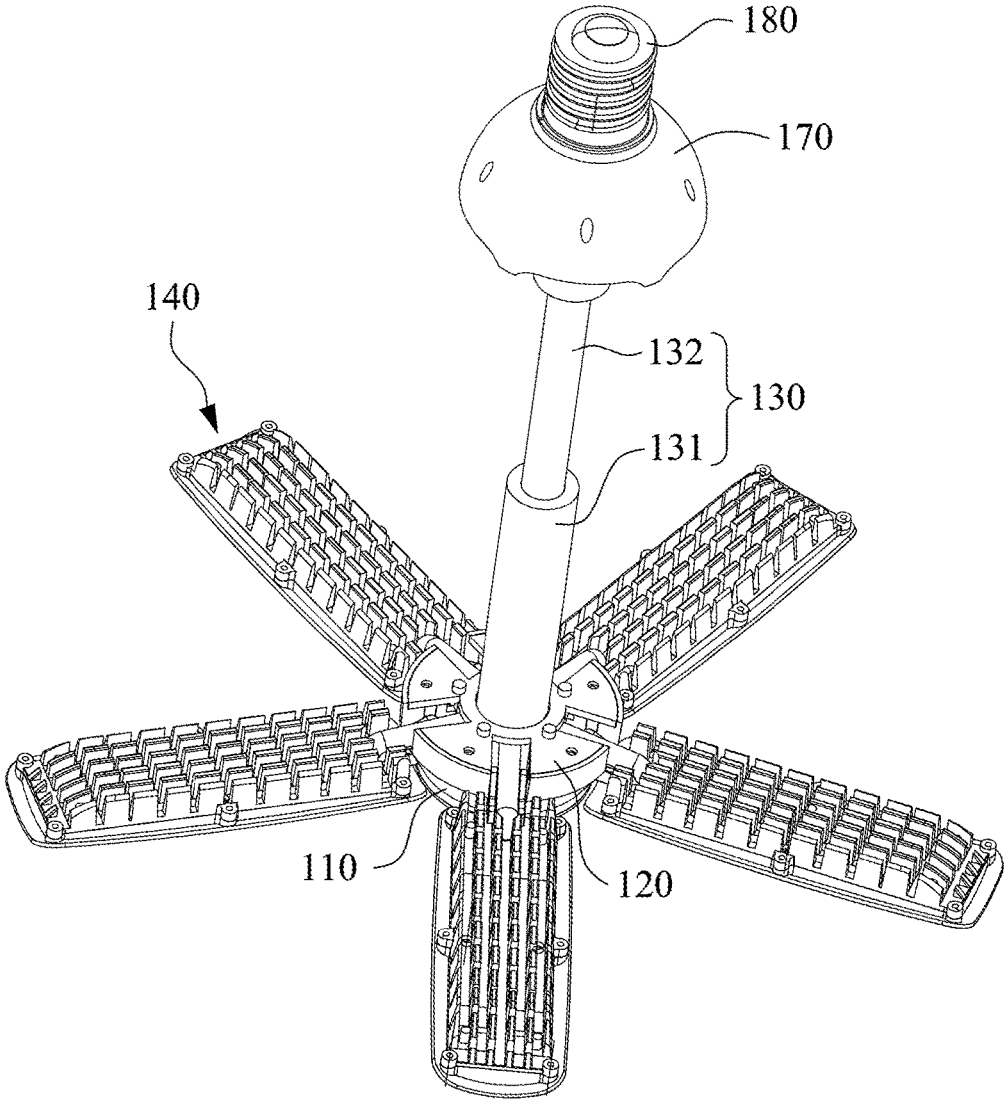
FIG. 7 is a schematic structural diagram showing a connecting rod in an elongated state.

Simultaneously referring to FIG. 3 and FIG. 7, FIG. 7 is a schematic structural diagram showing the connecting rod 130 in an elongated state. In some embodiments, the connecting rod 130 includes an outer tube 131 and an inner tube 132 engaged with each other, and the overall length of the connecting rod 130 can be changed by changing the relative position of the outer tube 131 and the inner tube 132. One end of the inner tube 132 is disposed with a resisting member 133, and the resisting member 133 contacts an inner wall of the outer tube 133. Therefore, the resisting member 133 can provide a frictional force to fix the inner tube 132 relative to the outer tube 131. In some embodiments, the outer tube 131 and the inner tube 132 can be screwed together, so that the length of the connecting rod 130 can be changed by changing the relative position of the outer tube 131 and the inner tube 132.

According to the aforementioned embodiments of the present invention, the light shape emitted from the lamp can be adjusted by changing the positioning angle of the first light source assembly. Moreover, the first light source assembly can be positioned at different required angles by engaging the teeth structure with the flat spring. In addition, the distance between the lamp cap and the first light source assembly can be changed by adjusting the length of the connecting rod, so that the illumination position of the lamp can be changed to meet different requirements.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A lamp, comprising:

a bottom base having a first side and a second side opposite to each other;

a connecting rod having a first end and a second end opposite to the first end, wherein the first end is disposed on the bottom base;

at least one first light source assembly, wherein one end of the first light source assembly is disposed on the first side of the bottom base, and the first light source assembly is swingable relative to the connecting rod with the one end of the first light source assembly as a swing center of the first light source assembly;

a connecting base disposed on the second end of the connecting rod;

a lamp housing having an accommodating space, wherein a circuit board is disposed in the accommodating space, and the circuit board is electrically connected to the first light source assembly, and the connecting base is disposed on the lamp housing and covers accommodating space; and a lamp cap disposed on one end of the lamp housing, wherein the lamp cap is electrically connected to the circuit board.

2. The lamp of claim 1, further comprising a plate structure disposed on the bottom base, wherein each of the at least one first light source assembly comprises:

a heat sink having an extending portion, wherein the extending portion extends from one end of the heat sink, and a pivot portion is disposed on one end of the extending portion;

a first light source substrate disposed on one side of the heat sink; and a first lamp cover covering the first light source substrate; and the bottom base has at least one recessed portion, wherein the extending portion is correspondingly disposed in the recessed portion, and the pivot portion is located between the plate structure and the bottom base.

3. The lamp of claim 2, wherein a teeth structure is disposed on the pivot portion; and a flat spring is disposed on a side surface of the plate structure facing the bottom base, wherein the flat spring is elastically engaged with the teeth structure.

4. The lamp of claim 2, wherein the heat sink has a through hole, and the first light source substrate is electrically connected to the circuit board via an electric wire, wherein the electric wire is put through the through hole and extends in the connecting rod to be connected to the first light source substrate and the circuit board.

5. The lamp of claim 4, further comprising a waterproof tube disposed in the recessed portion, wherein the waterproof tube has a first end and a second end opposite to each other, wherein the first end of the waterproof tube is communicated with the through hole of the heat sink, and the second end of the waterproof tube is communicated with an opening of the recessed portion, and the electric wire is put in the waterproof tube and extends to the bottom base.

6. The lamp of claim 1, further comprising a second light source assembly disposed on the second side of the bottom base, and the second light source assembly is electrically connected to the circuit board.

7. The lamp of claim 6, wherein the second light source assembly comprises:

a second light source substrate, wherein the second light source substrate is electrically connected to the circuit board via an electric wire which passes through the connecting rod; and a second lamp cover covering the second light source substrate.

8. The lamp of claim 2, further comprising a second light source assembly disposed on the second side of the bottom base, and the second light source assembly is electrically connected to the circuit board and the first light source assembly.

9. The lamp of claim 8, wherein the second light source assembly comprises a second light source substrate and a second lamp cover, wherein the second light source substrate is electrically connected to the circuit board via an electric wire, and the electric wire is connected to the circuit board by passing through the connecting rod; and the heat sink has a through hole, wherein the first light source substrate is electrically connected to the second light source substrate via the electric wire which passes through the through hole.

10. The lamp of claim 9, further comprising a waterproof tube disposed in the recessed portion, wherein the waterproof tube has a first end and a second end opposite to each other, wherein the first end of the waterproof tube is communicated with the through hole of the heat sink, and the second end of the waterproof tube is communicated with an opening of the recessed portion, and the electric wire is put in the waterproof tube and extends to the bottom base.

11. The lamp of claim 9, wherein the connecting rod comprises an outer tube and an inner tube engaged with each other.

12. The lamp of claim 1, wherein a waterproof sealer is disposed between the lamp housing and the connecting base.

13. The lamp of claim 2, wherein the first lamp cover is fixed on the heat sink, and a waterproof sealer is disposed between the first lamp cover and the heat sink.

14. The lamp of claim 7, wherein the second lamp cover is fixed on the bottom base, and a waterproof sealer is disposed between the second lamp cover and the bottom base.

15. The lamp of claim 9, wherein the second lamp cover is fixed on the bottom base, and a waterproof sealer is disposed between the second lamp cover and the bottom base.

* * * * *